US007854212B2

(12) United States Patent
Queiroz

(10) Patent No.: US 7,854,212 B2
(45) Date of Patent: Dec. 21, 2010

(54) PAINT SHIELD FOR ROOF STRUCTURE

(76) Inventor: Felipe S. Queiroz, 811 E. 100 North, #3, Logan, UT (US) 84321

( * ) Notice: Subject to any disclaimer, the term of this patent is extended or adjusted under 35 U.S.C. 154(b) by 1272 days.

(21) Appl. No.: 11/394,333

(22) Filed: Mar. 29, 2006

(65) Prior Publication Data

US 2008/0005973 A1 Jan. 10, 2008

Related U.S. Application Data

(60) Provisional application No. 60/666,605, filed on Mar. 31, 2005, provisional application No. 60/666,606, filed on Mar. 31, 2005.

(51) Int. Cl.
*E04D 13/00* (2006.01)

(52) U.S. Cl. ..... 118/500; 52/97

(58) Field of Classification Search ..... 118/500–505, 118/301, 406, 213; 52/97
See application file for complete search history.

(56) References Cited

U.S. PATENT DOCUMENTS

| | | | | |
|---|---|---|---|---|
| 1,693,098 | A | 11/1928 | Taylor | |
| 1,770,914 | A * | 7/1930 | Diven | 40/307 |
| 2,290,472 | A | 7/1942 | Hendrick | |
| 2,332,579 | A | 10/1943 | Kirby | |
| 3,380,435 | A | 4/1968 | Wagner et al. | |
| 3,633,542 | A | 1/1972 | Read et al. | |
| 3,962,989 | A | 6/1976 | Groff | |
| 4,005,678 | A | 2/1977 | O'Toole | |
| 4,051,808 | A | 10/1977 | Trupp | |
| 4,085,703 | A | 4/1978 | Glowacki | |
| 4,559,245 | A | 12/1985 | Stark | |
| 5,103,762 | A | 4/1992 | Long et al. | |
| 5,611,173 | A | 3/1997 | Headrick et al. | |
| 5,787,556 | A * | 8/1998 | Terzian | 24/545 |
| 5,809,901 | A * | 9/1998 | Gutzmer | 108/27 |
| 6,808,794 | B1 | 10/2004 | Mattox | |

* cited by examiner

*Primary Examiner*—Parviz Hassanzadeh
*Assistant Examiner*—Charles J Capozzi
(74) *Attorney, Agent, or Firm*—David L. Stott

(57) ABSTRACT

A self-retained paint shield configured to shield an exterior roof structure while spray painting exterior side walls of a home or building. The paint shield includes a shield portion and an exterior-roof attachment portion. The shield portion is configured to shield at least a portion of the roof structure from paint spray. The exterior-roof attachment portion is connected to the shield portion and includes two upwardly extending attachment side walls extending at a lower end from each other. With this arrangement, the exterior-roof attachment portion is configured to attach to the end of the roof structure in a self-retained manner while the shield portion shields at least a portion of the roof structure from paint spray.

18 Claims, 4 Drawing Sheets

PAINT SHIELD FOR ROOF STRUCTURE

REFERENCE TO RELATED APPLICATIONS

This application claims benefit of both U.S. Provisional Application Ser. Nos. 60/666,605 and 60/666,606, each filed Mar. 31, 2005, the entirety of each disclosure being incorporated herein by reference thereto.

BACKGROUND OF THE INVENTION

1. Field of the Invention

The present invention relates to a method and apparatus for shielding paint from being sprayed onto a roof structure of a building or home and, specifically, a paint shield configured to be temporarily self-retained to the roof structure to shield overspray from the roof structure while painting a side wall of the building or home.

2. State of the Art

When painting, it is obviously desirable that surfaces which should not receive paint, do not receive paint. For this reason, various paint shields have been developed over the years. Typical paint shields can include various hand-held devices with rigid straight edges, masking tape and even paper with an adhesive edge. Many of the paint shields on the market today are for indoor use for painting the interior walls, molding and ceiling of a home or building. When painting large surface areas, paint sprayers are often employed. Paint sprayers may be more efficient; however, painting with a sprayer often leads to spraying undesired surfaces. To overcome this problem, there are large paint shields with long handles available. However, these long-handled paint shields must be held by a painter in one hand while holding the paint sprayer in the other hand. This arrangement of manually holding the shield while painting is tiresome and cumbersome, resulting in fatigue and unavoidably leading to mistakes, discontinuities in the painted surface (due to undesired movement of the shield while painting) and accidental overspray to undesired surfaces not meant to be painted. Further, the accidental overspray problem becomes perpetuated due to the limited shield width of the long-handled paint shields.

Painters are often contracted to paint the exterior surfaces of homes. Exterior surfaces are usually very large surfaces and, as such, painters typically use paint sprayers to increase their efficiency. Typical to most exterior surfaces, the side walls are the desired painting surface and the roof structure is the undesired surface for receiving paint. Painters often employ the same long-handled paint shields used for interior use for exterior use to prevent over-spray from getting on the roof structure. Although a long-handled paint shield can assist in preventing over-spray from getting on the roof structure, the above-identified problem relating to manually holding a long-handled paint shield while painting is perpetuated due to the large surface areas at the exterior of the home.

Accordingly, there exists a need for a paint shield made specifically for exterior surfaces that allows the painter the efficiency desired by employing a paint sprayer while also limiting the painter's fatigue by limiting the necessary tools the painter must handle while painting. There also exists a need for a paint shield that shields large areas or entire side walls at a time, thereby limiting the potential of mistakes and overspray to undesired surfaces.

BRIEF SUMMARY OF THE INVENTION

In view of the shortcomings in the art, it would be advantageous to provide a paint shield that temporarily attaches to a roof structure of a home to shield the roof structure while spray painting side walls of the home.

Accordingly, the present invention relates to a self-retained paint shield for shielding an exterior roof structure while spray painting exterior side walls of a home or building. The paint shield includes a shield portion and an exterior-roof attachment portion. The shield portion is configured to shield at least a portion of the roof structure from paint spray. The exterior-roof attachment portion is connected to the shield portion and includes two upwardly extending attachment side walls extending at a lower end from each other. With this arrangement, the exterior-roof attachment portion is configured to attach to the end of the roof structure in a self-retained manner while the shield portion shields at least a portion of the roof structure from paint spray.

In another embodiment of the present invention, the paint shield can include a primary paint shield and an elongated roof-attachment element. The elongated element includes a longitudinal length having a cross-section with a W-shaped configuration extending substantially along the longitudinal length thereof. Further, the elongated element can include a roof attachment portion and a shield attachment portion. The roof attachment portion is configured to attach to an end of a roof structure so that the elongated element is self-retained to the roof structure. The shield attachment portion can be connected to the roof attachment portion and includes a shield portion configured to shield paint spray. Further, the shield attachment portion is configured to receive and removably retain the primary shield in a self-retained manner.

In another embodiment of the present invention, the paint shield includes an elongated roof-attachment element. The elongated element includes a longitudinal length having a cross-section with a J-shaped configuration extending substantially along the longitudinal length thereof. Further, the elongated element can include a roof attachment portion and a shield portion. The roof attachment portion is configured to attach to an end of a roof structure so that the elongated element is self-retained to the roof structure. The shield portion is interconnected with the roof attachment portion and is configured to extend upward above the roof attachment portion to shield the roof structure from paint spray.

In one embodiment, the present invention provides that the roof attachment portion of the elongated element, or the paint shield, can be removably retained to a drip edge of the roof structure with an interference type fit.

Other features and advantages of the present invention will become apparent to those of ordinary skill in the art through consideration of the ensuing description, the accompanying drawings, and the appended claims.

BRIEF DESCRIPTION OF THE SEVERAL VIEWS OF THE DRAWINGS

While the specification concludes with claims particularly pointing out and distinctly claiming that which is regarded as the present invention, the advantages of this invention may be ascertained from the following description of the invention when read in conjunction with the accompanying drawings, in which:

DETAILED DESCRIPTION OF THE INVENTION

Figure 1:
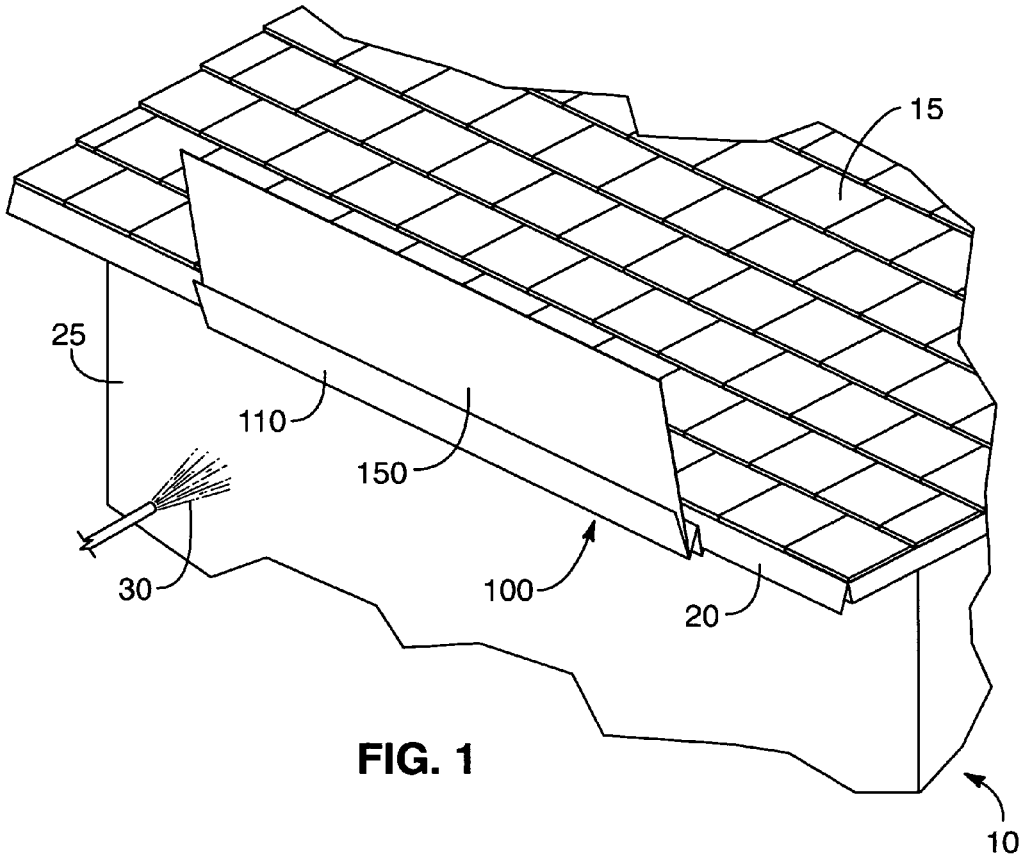
FIG. 1 is a partial perspective view of a roof structure having a paint shield assembly attached to a drip edge of the roof structure, according to one embodiment of the present invention.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

Figure 2:
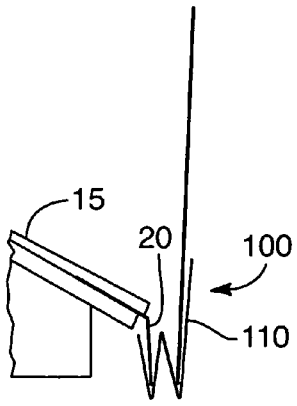
FIG. 2 is a partial side view of the roof structure with the paint shield assembly attached to the drip edge of the roof structure, according to the present invention.
Figure 3:
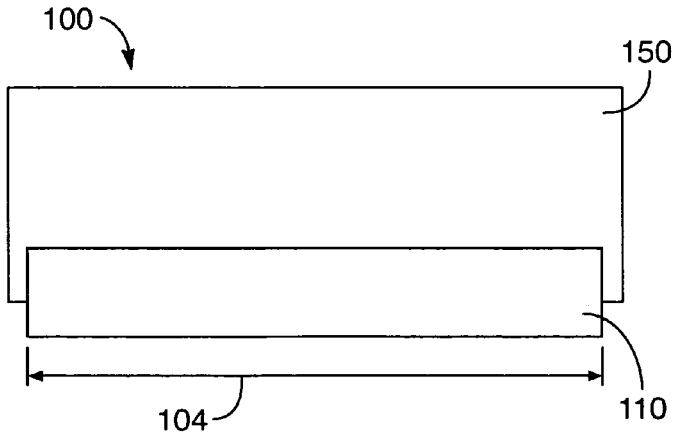
FIG. 3 is front view of the paint shield assembly, according to the present invention.

Referring to FIGS. 1-3, there is illustrated a paint shield 100 configured to temporarily attach to a house 10 or building while a person manually paints a side wall 25 of the house. In one embodiment, the paint shield 100 can attach to a drip edge 20 of a roof structure 15. The drip edge 20 is formed within and integrated with an end portion of the roof structure and typically formed in pitched roof structures. Such drip edge 20 is configured to prevent water from being drawn back into the eaves of a home and seeping within the walls. This seepage can result in water damage and mold spores growing within the walls of homes, resulting in monetary damage as well as health problems. As such, the drip edge is a standard component in the construction of pitched roofs. The drip edge 20 and the roof structure 15 are typically the undesired painting surfaces of the home 10. According to the present invention, the paint shield 100 of the present invention is configured to attach to the drip edge 20 at the roof's end to, thereby, serve as a shield in substantially preventing paint spray 30 from being sprayed on the drip edge as well as the roof structure while painting the side walls of the home.

In one embodiment, the paint shield 100 includes an elongated element 110 and a primary shield 150. The elongated element can include a substantially W-shaped cross-section configured to attach and be self-held or self-retained to the drip edge 20 of a pitched roof of the home. Such elongated element 110 is also configured to receive the primary shield 150 in a self-retained manner. With this arrangement, the elongated element 100 and the primary shield 150 both substantially prevent and shield the roof structure 15 and the drip edge 20 from receiving undesired paint spray 30 while a person manually sprays the side wall 25 or painting surface of the home 10. Furthermore, the W-shaped configuration can provide an interference type fit for retaining the elongated element 110 to the drip edge 20 as well as retaining the primary shield 150 to the elongated element, thereby, allowing for easy removal and placement thereof.

Figure 4:
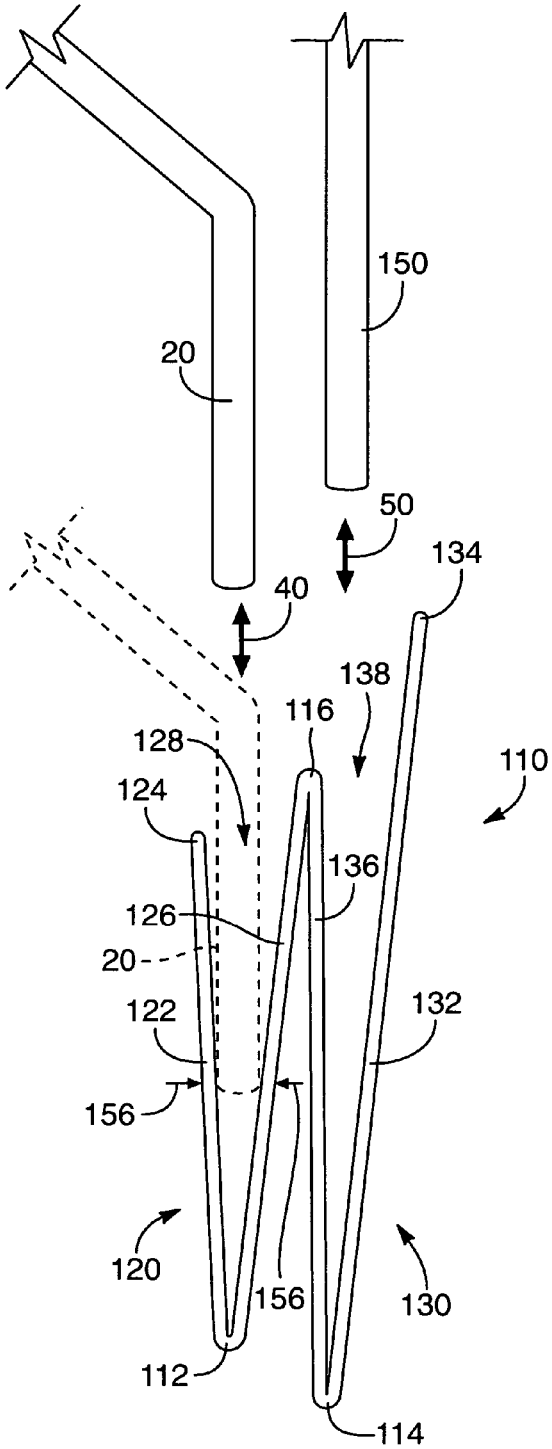
FIG. 4 is an enlarged side view of the paint shield assembly, in unassembled form, illustrating where the paint shield assembly attaches to the drip edge, according to the present invention.

FIG. 4 illustrates an enlarged side view of the paint shield 100, illustrating the drip edge 20 and primary shield 150 disposed separate and above the elongated element 110 and illustrating placement of the drip edge 20 and primary shield 150 to pockets or slots with respect to the elongated element 110 via bi-directional arrows 40 and 50. Turning first to specific reference to the elongated element 110, such elongated element 110 can include a series of bends therein, each defining various components within the elongated element 110 and each extending along a longitudinal length 104 (FIG. 3) of the elongated element 110 to, thereby, form the substantially W-shaped configuration. Such W-shaped configuration is a cross-sectional view, transverse to the longitudinal length of the element 110. The series of bends in the elongated element 110 can include a first lower bend 112 and a second lower bend 114 with an upper middle bend 116 disposed therebetween, the various components being separated by the series of bends. Such bends in the W-shaped configuration can provide a drip attachment portion 120 and a shield attachment portion 130.

The drip attachment portion 120 is defined by a back portion 122 and a first intermediate portion 126. The back portion 122 extends upwardly from the first lower bend 112 to a back free end 124. The first intermediate portion 126 extends upwardly from the first lower bend 112 to the upper middle bend 116. As such, the back portion 122 and first intermediate portion 126 extend upwardly from the first lower bend 112 to define a first pocket 128. The first pocket 128 is sized and configured to receive and retain the drip edge 20 to allow the elongated element 110 to be self-retained to the drip edge 20.

As previously indicated, the drip attachment portion 120 can be self-retained to the drip edge 20 with an interference type fit (drip edge 20 shown in outline), allowing for easy positioning, removal and retention of the elongated element 110 to the drip edge 20. The interference type fit is employed due to the first pocket 128 narrowing as a function of depth as defined by the back portion 122 and the first intermediate portion converging at the first lower bend 112. With this arrangement, as the first pocket receives the drip edge and is forced therein, the back portion 122 and the first intermediate portion 126 resist separation (shown by arrows 156), thereby, providing a spring-like effect or interference type fit to temporarily retain the elongated element 110 to the drip edge 20. The resistive strength or spring strength of the drip attachment portion 120 can be modified via various factors, such as, but not limited to, length of the back portion 122 and first intermediate portion 126, material type employed for the elongated element 110, thickness of the elongated element 110 and drip edge 20, etc., as known by one of ordinary skill in the art. Further, it should be noted that alternate or additional attachment means for the drip attachment portion 120 can be employed, such as utilizing clips, hangers, clamps, adhesive, magnetic means or any other suitable temporary attachment means, or any other structure suitable for providing an interference type fit, known in the art.

The shield attachment portion 130 is defined by a shield portion 132 and a second intermediate portion 136. The shield portion 132 extends upwardly from the second lower bend 114 to a shield free end 134 whereas the second intermediate portion 136 extends upwardly from the second lower bend 114 to the upper middle bend 116. Similar to the drip attachment portion 120, the shield portion 132 and the second intermediate portion 136 extend upwardly from the second lower bend 114 to define a second pocket 138 for receiving and retaining the primary shield 150 to be self-retained therein with an interference type fit. As such, the shield attachment portion 130 is sized and configured to provide the necessary spring-like component to retain and readily remove the primary shield 150 to and from the shield attachment portion 130. Further, other or additional attachment means of the primary shield 150 to the shield attachment portion 130 may be employed, such as by utilizing clips, hangers, clamps, adhesive, magnetic means or any other suitable temporary attachment means known in the art. Further, the shield attachment portion 130 may include alternate structure than that disclosed that provides an interference type fit for the primary shield to be retained to the elongated element 110.

The W-shaped configuration of the elongated element 110 can be a modified into various shapes, additional lengths and bends. Further, such elongated element 110 can be made from thinly formed resilient material, such as sheet metal, formed from any known resilient material such as steel, aluminum, tin, etc. or polymer type materials, or any other types of materials providing a resilient effect to allow the elongated element 110 to resiliently self-hold to the drip edge 20 as well as resiliently hold the primary shield 150. As known by one of ordinary skill in the relevant art, the elongated element 110 can be readily made from, for example, sheet metal and bent at appropriate positions to form the desired W-shaped configuration.

The primary shield 150 can be made from card-board, or any other suitable material, such as plastic, aluminum or sheet metal. The primary shield 150 can be sized and configured with an elongated length that is slightly longer than the length 104 (FIG. 3) of the elongated element 110 for inherent reasons discussed in reference to FIGS. 8 and 9. The elongated element 110 can include, but is not limited to, a longitudinal length of approximately three to seven feet and, preferably about four to six feet in length. The W-shaped configuration can include, but is not limited to, a height of approximately one to three inches and, preferably, about two inches in height. The primary shield 150 can include, but is not limited to, a height of approximately one foot and is typically about ⅛ of an inch thick to provide the proper interference fit with the elongated element 110. Of course, as known by one of ordinary skill in the relevant art, other sizes may be employed to achieve similar results.

Figure 5:
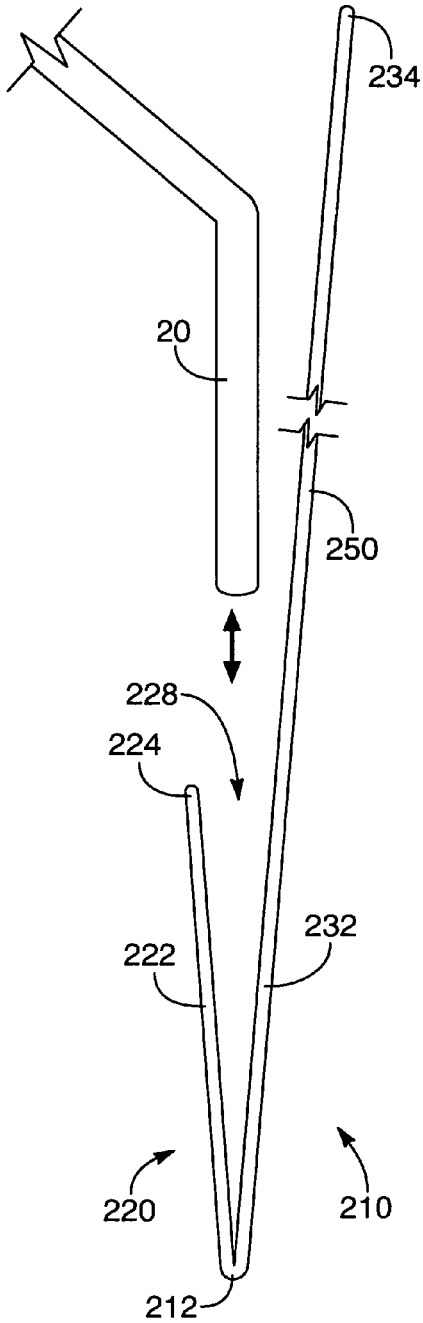
FIG. 5 is an enlarged side view of another embodiment of a paint shield, illustrating where the paint shield attaches to the drip edge of a roof structure, according to the present invention.

FIG. 5 illustrates another embodiment of the elongated element 210, illustrating an enlarged side view of a substantially J-shaped configuration or cross-section of the elongated element 210. Here, the elongated element 210 can include a drip attachment portion 220 with a lower bend 212, each extending substantially along the longitudinal length (not shown) of the element 210. The drip attachment portion 220 is defined by a back portion 222 extending upwardly from the lower bend 212 to a back free end 224 and a lower shield portion 232 of a shield portion 250 that extends upwardly from the lower bend 212. Such lower shield portion 232 and back portion 222 extending from the lower bend 212 define a pocket 228 sized and configured to receive and retain the drip edge 20 of the roof structure (not shown) to be self-retained therein with an interference type fit. In this manner, the lower shield portion 232 serves two purposes: to act in conjunction with the back portion 222 as the drip attachment portion 220 and to provide a shield for at least the drip edge 20 of the roof structure from paint spray. Further, in this embodiment, the shield portion 250 extends upwardly to a shield free end 234, which is well beyond the upward height of the back portion 222 to act as the primary shield 150 (FIG. 4) shown in the previous embodiment. As such, in this embodiment, the additional upward height of the shield portion 250 allows for the paint shield of the present invention to be made primarily as a unitary structure or, otherwise said, a one-piece structure.

In this embodiment, the elongated element 210 can be made with similar materials, lengths, heights, etc. as that disclosed for the elongated element in the previous embodiment. Since the shield portion 250 in this embodiment can be made as a unitary structure with the drip attachment portion 220, it should be noted that the shield portion 250 can extend to any suitable height, such as six inches to twenty-four inches and, preferably, between about eight to sixteen inches.

Further, as will be readily apparent to one of ordinary skill in the art, the present invention is not limited to one or two lower bends within the elongated element. For example, there may be additional bends within the elongated element in order to gain the clearance necessary to bypass an end of the pitched roof structure. Some examples of such additional bends are disclosed in the following embodiments illustrated in FIGS. 6 and 7.

Figure 6:
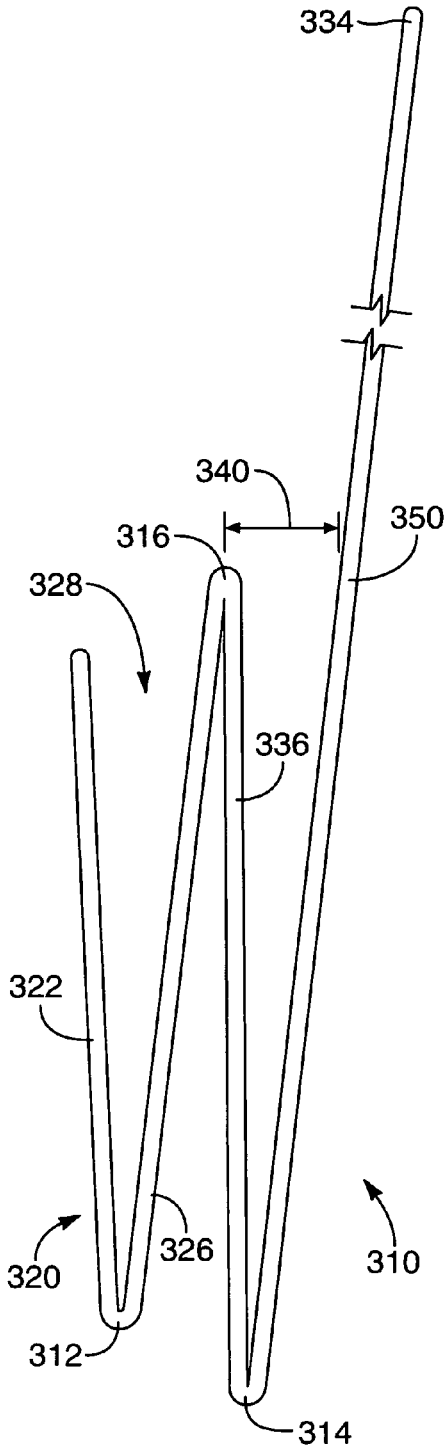
FIG. 6 is an enlarged side view of another embodiment of a paint shield, according to the present invention.

With respect to FIG. 6, another embodiment is disclosed of an elongated element 310 that combines some of the features in both the W-shaped configuration and the J-shaped configuration. In particular, this embodiment includes a W-shaped configuration having a drip attachment portion 320 and a shield portion 350. The drip attachment portion 320 can be defined by a back portion 322 and a first intermediate portion 326, each extending upwardly from a first bend 312 in the elongated element 310, to define a first pocket 328 for receiving and retaining the drip edge of the roof structure. Further, the shield portion 350 is similar to the J-shaped configuration in that the shield portion extends upwardly to a height that shields both the drip edge and the roof structure from paint spray. The elongated element 310 includes a second lower bend 314 extending to both the shield portion 350 and a second intermediate portion 336 to define a second pocket 338 and provide a gap 340, to thereby, provide clearance for the shield portion 350 to bypass the end of the roof structure. The gap is defined from an upper middle bend 316 and a back surface of the shield portion 350, the first and second intermediate portions 326 and 336 extending downwardly from the upper middle bend 316. As such, the elongated element 310 of this embodiment can be made as a unitary structure and provides a gap 340 to allow the shield portion 350 to bypass the end of the roof structure.

Figure 7:
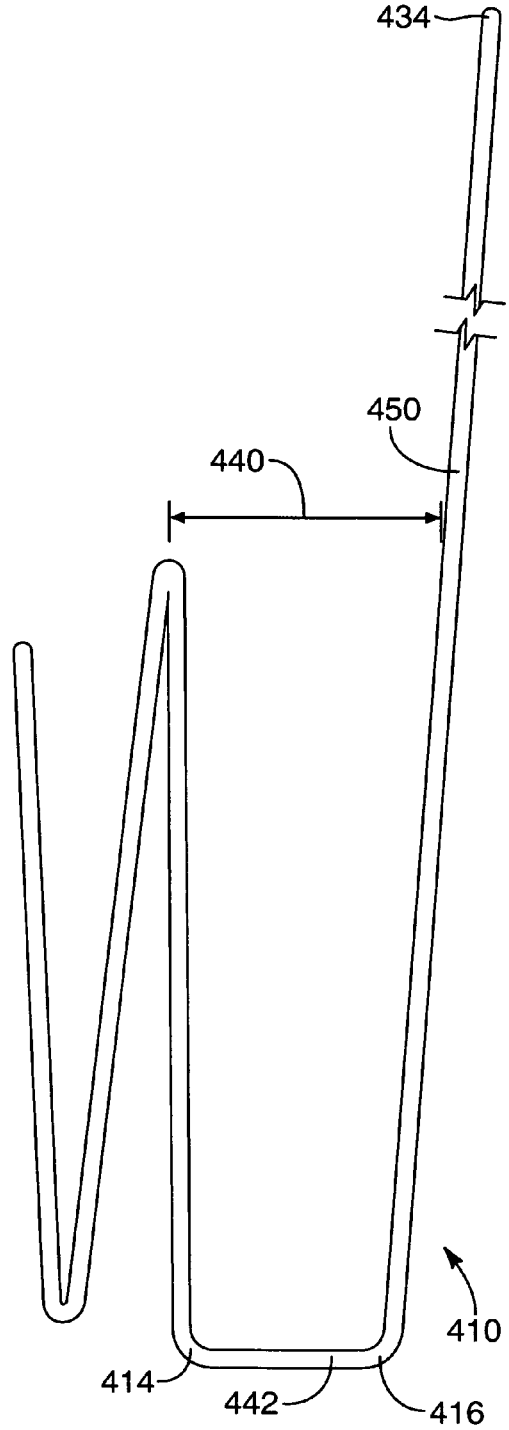
FIG. 7 is an enlarged side view of another embodiment of a paint shield, according to the present invention.

FIG. 7 is another embodiment of an elongated element 410, similar to the previous embodiment disclosed with reference to FIG. 6, but including a lower extension 442 disposed between two lower bends 414 and 416 in the elongated element 410. Such lower extension 442 provides for an additional length in a gap 440 needed for a shield portion 450 extending upward from the lower extension 442 to bypass the end of the roof structure. As in the previous two embodiments, the shield portion 450 extends upwardly to a shield free end 434 to a height necessary to shield both the drip edge and the roof structure from paint spray while painting the side wall of a home or building.

Figure 8:
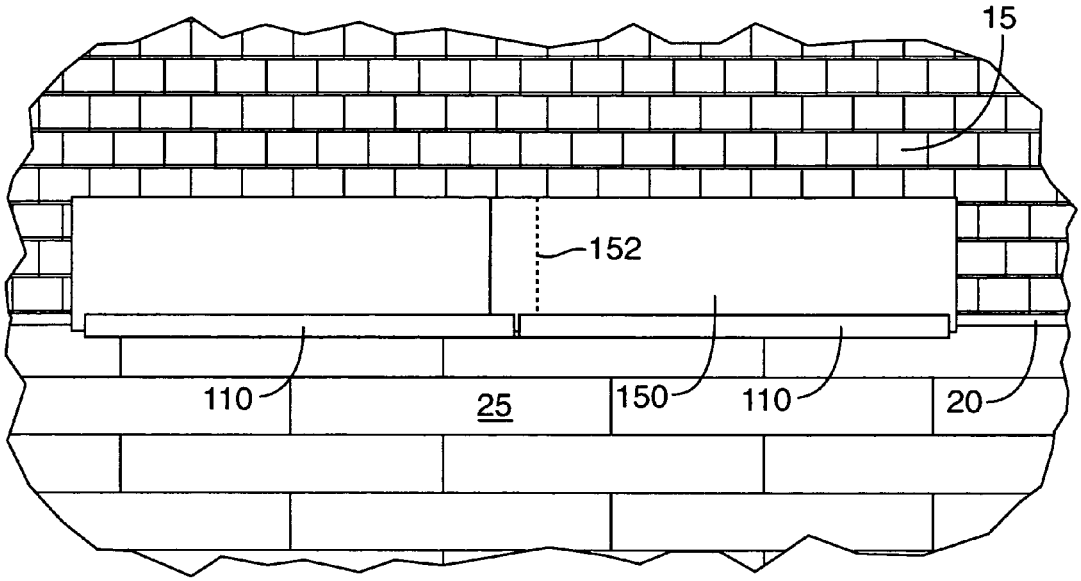
FIG. 8 is a partial front view of a roof structure having two paint shield assemblies attached to the drip edge of the roof structure, illustrating an overlap between the two adjacently attached paint shield assemblies, according to an embodiment of the present invention.
Figure 9:
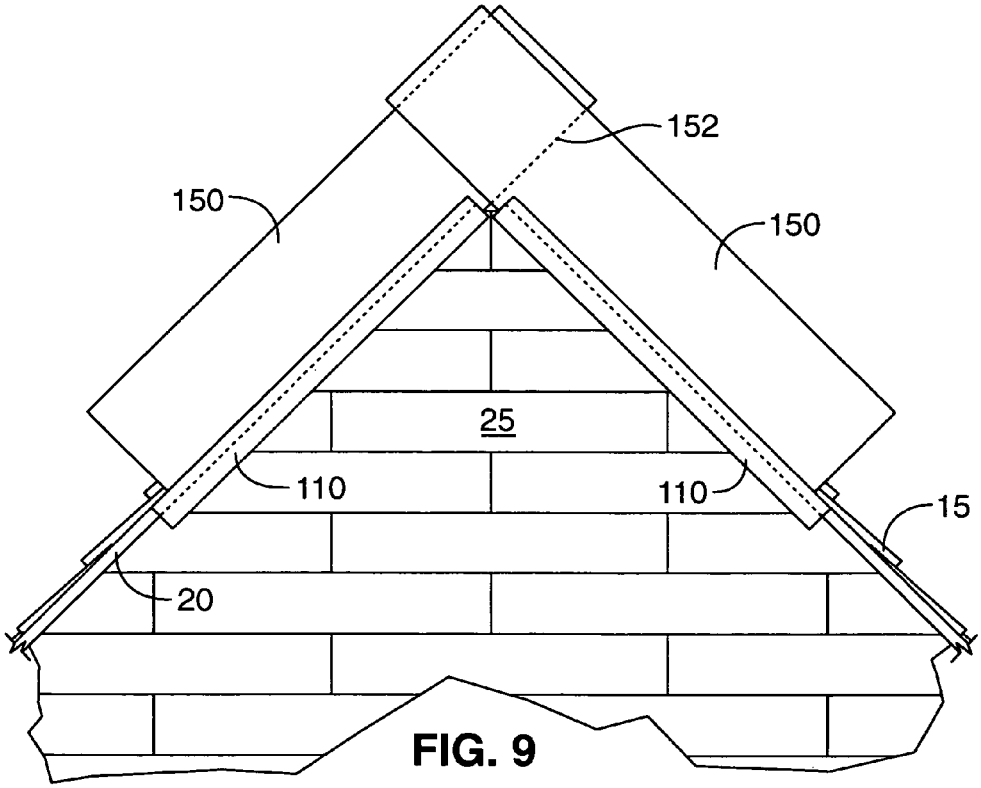
FIG. 9 is a partial front view of a gabled roof structure having two paint shield assemblies on each side of the gabled roof structure, illustrating an overlap between the two paint shield assemblies attached to the drip edge, according to the present invention.

FIGS. 8 and 9 illustrate how two adjacently disposed elongated elements 110, each attached to the roof structure 15, with their respective primary shields 150 can be placed to substantially prevent paint spray from spraying onto the roof structure while painting a side wall 25 of a home 10. For example, as shown in FIG. 8, two elongated elements 110 can be attached to the drip edge 20 so that one end of an element 110 can adjacently but-up against another element 110. The primary shield 150 for each element 110 can then be positioned so that the primary shield 150 for one element 110 can overlap 152 (shown in outline) the primary shield 150 of the adjacently disposed element 110 to, thereby, prevent any undesired gap between the respective primary shields and to prevent undesired paint spray from getting onto the roof structure 15. FIG. 9 illustrates another example for a gabled roof structure, disclosing one embodiment for attaching two elongated elements 110 to the drip edge 20 and positioning the primary shields 150 for each elongated element so that the primary shields 150 overlap 152 (shown in outline), closing-off any potential gap, to thereby, shield the roof structure 15 from paint spray when painting the side wall 25 of the home 10. With this arrangement disclosed with reference to FIGS. 8 and 9, multiple paint shields can be attached to the roof structure along, if desired, an entire length of a home, thereby allowing an entire side wall to be spray painted while substantially shielding the roof structure from paint spray. Such arrangement provides for greater efficiency, greater continuity in the painted surface and substantially prevents mistakes and fatigue that otherwise would be eminent if using the know manually held long-handled paint shields.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention includes all modifications, equivalents, and alternatives falling within the spirit and scope of the invention as defined by the following appended claims.

What is claimed is:

1. A paint shield for an exterior roof structure, the paint shield comprising:

an elongated element having a cross-section with a W-shaped configuration, the elongated element including:

a shield portion configured to shield a portion of the roof structure from paint spray; and an exterior-roof attachment portion connected to the shield portion and including two upwardly extending attachment sides walls extending from a lower portion thereof and configured to attach to an end portion of the roof structure in a self-retained manner;

wherein the shield portion is spaced from the attachment portion to provide a gap, the shield portion extending upwardly to bypass the roof structure.

2. The paint shield of claim 1, wherein the attachment portion is configured to be self-retained to the roof structure with an interference type fit.

3. The paint shield of claim 1, wherein the W-shaped configuration define a first pocket and a second pocket, each pocket being upwardly exposed, the first pocket being configured to receive the end portion of the roof structure and the second pocket being configured to receive a primary shield and being at least partially disposed behind the shield portion.

4. The paint shield of claim 1, further comprising a primary shield configured to be disposed at least partially behind the shield portion and configured to be self-retained therebehind with an interference fit.

5. The paint shield of claim 1, wherein the W-shaped configuration extends substantially along a longitudinal length of the elongated element.

6. The paint shield of claim 1, wherein the shield portion upwardly extends to a height higher than the attachment portion to shield the roof structure from paint spray.

7. The paint shield of claim 1, wherein the elongated element comprises at least one of a sheet metal and a polymer type material.

8. A paint shield for an exterior roof structure, the paint shield comprising:

a primary paint shield; and an elongated roof attachment element having a longitudinal length, the elongated element having a cross-section with a W-shaped configuration extending substantially along the longitudinal length thereof, the elongated element including:

a roof attachment portion configured to attach to an end of a roof structure so that the elongated element is self-retained to the roof structure; and a shield attachment portion connected to the roof attachment portion and including a shield portion configured to shield paint spray, the shield attachment portion configured to receive and removably retain the primary shield in a self-retained manner.

9. The paint shield of claim 8, wherein the primary shield includes a longitudinal length of at least the longitudinal length of the elongated element.

10. The paint shield of claim 8, wherein the roof attachment portion of the elongated element comprises a back portion and a first intermediate portion each extending from a first bend in the elongated element to define a first pocket, the first pocket being configured to receive a drip edge of the roof structure with an interference type fit.

11. The paint shield of claim 10, wherein the shield attachment portion of the elongated element comprises the shield portion and a second intermediate portion each extending from a second bend in the elongated element to define a second pocket, the second pocket being configured to receive the primary shield with an interference type fit.

12. The paint shield of claim 11, wherein the first intermediate portion and the second intermediate portion each extend from an upper middle bend in the elongated element.

13. A paint shield for an exterior roof structure, the paint shield comprising:

a primary shield; and an elongated element having a longitudinal length, the elongated element having a cross-section with a W-shaped configuration extending substantially along the longitudinal length thereof, the elongated element including:

a roof attachment portion configured to attach to an end portion of the roof structure so that the elongated element is self-retained to the roof structure; and a shield portion interconnected to the roof attachment portion, the shield portion configured to shield paint spray;

wherein the primary shield is configured to be disposed at least partially behind the shield portion and configured to be self-retained therebehind with an interference fit.

14. The paint shield of claim 13, wherein the roof attachment portion is configured to be self-retained to the roof structure with an interference type fit.

15. The paint shield of claim 13, wherein the W-shaped configuration define a first pocket and a second pocket, each of the first pocket and the second pocket being upwardly exposed, the first pocket being configured to receive the end portion of the roof structure and the second pocket being configured to receive a primary shield and being at least partially disposed behind the shield portion.

16. The paint shield of claim 13, wherein the shield portion is spaced from the roof attachment portion to provide a gap so that the upwardly extending shield portion bypasses the roof structure.

17. The paint shield of claim 13, wherein the shield portion upwardly extends to a height higher than the roof attachment portion to shield the roof structure from paint spray.

18. The paint shield of claim 13, wherein the elongated element comprises at least one of a sheet metal and a polymer type material.

* * * * *